US011149541B2

(12) United States Patent
Barbour

(10) Patent No.: US 11,149,541 B2
(45) Date of Patent: Oct. 19, 2021

(54) PUMP ISOLATION APPARATUS AND METHOD FOR USE IN TUBING STRING PRESSURE TESTING

(71) Applicant: Husky Oil Operations Limited, Calgary (CA)

(72) Inventor: Stephen Gerard Barbour, Lloydminster (CA)

(73) Assignee: Husky Oil Operations Limited, Calgary (CA)

( * ) Notice: Subject to any disclaimer, the term of this patent is extended or adjusted under 35 U.S.C. 154(b) by 169 days.

(21) Appl. No.: 15/750,255

(22) PCT Filed: Aug. 5, 2015

(86) PCT No.: PCT/CA2015/000451

§ 371 (c)(1),
(2) Date: Feb. 5, 2018

(87) PCT Pub. No.: WO2017/020109

PCT Pub. Date: Feb. 9, 2017

(65) Prior Publication Data

US 2018/0230798 A1 Aug. 16, 2018

(51) Int. Cl.
*E21B 47/117* (2012.01)
*E21B 33/12* (2006.01)
(Continued)

(52) U.S. Cl.
CPC ..... *E21B 47/117* (2020.05); *E21B 33/12* (2013.01); *E21B 43/126* (2013.01); *E21B 47/06* (2013.01);
(Continued)

(58) Field of Classification Search
CPC ..... E21B 47/1025; E21B 47/06; E21B 4/117; E21B 33/12; E21B 43/126; E21B 43/127;
(Continued)

(56) References Cited

U.S. PATENT DOCUMENTS 3,817,327 A 6/1974 Grable et al.
4,406,561 A 9/1983 Ewing
(Continued)

FOREIGN PATENT DOCUMENTS

CA 2562159 4/2007
WO WO 2014/186859 11/2014

OTHER PUBLICATIONS

International Search Report and Written Opinion dated Apr. 11, 2016 for Application No. PCT/CA2015/000451, 7 pgs.

*Primary Examiner* — George S Gray
(74) *Attorney, Agent, or Firm* — Gordon & Jacobson, P.C.

(57) ABSTRACT

An apparatus and method for pressure testing a tubing string of a fluid production well, the tubing string being provided with a progressing cavity pump at a downhole end, which apparatus and method can be used to help determine whether the tubing string has failed or the pump has failed. The apparatus comprises a plug member connected to the rod string assembly that includes the pump rotor, such that the rod string assembly can be lowered to seat the plug member in a seat member within the tubing string above the pump, thus sealing off and isolating the pump from the rest of the tubing string, allowing pressure testing of the tubing string above the pump.

12 Claims, 27 Drawing Sheets

(51) Int. Cl.

| | |
|---|---|
| ***E21B 47/06*** | (2012.01) |
| ***E21B 43/12*** | (2006.01) |
| ***F04C 2/107*** | (2006.01) |
| ***F04C 13/00*** | (2006.01) |
| ***F04C 14/28*** | (2006.01) |

(52) U.S. Cl.
CPC ..... *F04C 2/1071* (2013.01); *F04C 2/1073* (2013.01); *F04C 13/008* (2013.01); *F04C 14/28* (2013.01); *F04C 2230/60* (2013.01); *F04C 2230/70* (2013.01)

(58) Field of Classification Search
CPC ..... E21B 43/121; E21B 43/13; F04C 2/1071; F04C 2/1073; F04C 14/28; F04C 13/008; F04C 2230/60; F04C 2230/70; F16K 41/14; F16K 41/16
See application file for complete search history.

(56) References Cited

U.S. PATENT DOCUMENTS

| | | | | |
|---|---|---|---|---|
| 5,209,294 | A * | 5/1993 | Weber | E21B 43/121 166/105 |
| 5,289,884 | A | 3/1994 | Johnstone | |
| 5,549,160 | A * | 8/1996 | Bownes | E21B 43/126 166/106 |
| 6,729,391 | B2 | 5/2004 | Hill et al. | |
| 7,201,222 | B2 | 4/2007 | Kanady et al. | |
| 2005/0263289 | A1 * | 12/2005 | Kanady | E21B 43/126 166/369 |
| 2009/0242195 | A1 * | 10/2009 | Wicentovich | E21B 43/127 166/244.1 |
| 2011/0259610 | A1 * | 10/2011 | Shkurti | E21B 33/1204 166/386 |
| 2013/0104643 | A1 * | 5/2013 | Tokarek | E21B 47/1025 73/152.54 |

* cited by examiner

PUMP ISOLATION APPARATUS AND METHOD FOR USE IN TUBING STRING PRESSURE TESTING

CROSS-REFERENCE TO RELATED APPLICATION

This application is claims priority to and benefit of International Application No. PCT/CA2015/000451, entitled "PUMP ISOLATION APPARATUS AND METHOD FOR USE IN TUBING STRING PRESSURE TESTING," filed Aug. 5, 2015, the contents of which are incorporated by reference in its entirety for all purposes.

FIELD OF THE INVENTION

The present invention relates to methods for testing failure of well equipment, and specifically failure of tubing strings and downhole pumps.

BACKGROUND OF THE INVENTION

In the art of pumping fluids to surface from downhole reservoirs, it is well known to employ a type of positive displacement pump called a progressing cavity pump (PCP), also known as a "Moineau pump" after its inventor René Moineau. A PCP conventionally comprises a stator and a rotor, the rotor in the form of a single helix (normally composed of metal) eccentrically located within an elastomeric stator inner cavity which cavity takes the form of a double helix, although other arrangements are known in the art. When the stator and rotor are mated together, they thus form a plurality of cavities which progress axially in response to rotation of the rotor. The rotor is normally rotated by means of a rod string from which the rotor depends from surface (the rod string and rotor being components of the rod string assembly), with the rotor capable of operation as a pump when rotated by the rod string which is typically driven by a motor on surface. The rod string assembly may comprise various components, including the rod box connection, sucker or continuous rod, connector rod, rod shear, rod centralizer and the rotor. The stator is conventionally connected to the downhole end of a tubing string with a pump intake end typically located at the bottom of the stator. The tubing string may comprise various components, including tubing joints, tubing pup joints, tubing collars, a tubing drain and the stator. The stator is normally secured to the downstream end of the tubing string and run into the hole to the desired depth, and the rotor is then run into the tubing string interior at the end of a rod string, the rotor then threaded into the stator at depth. When the pump is operated, fluid production can then be undertaken through the pump and upwards through the tubing string and into surface facilities.

However, it is also known that downhole equipment failures may occur with time, either in the tubing string or in the PCP. For example, the rotor rotates in an eccentric manner within the stator, and this eccentricity is imparted to the rod string, such that the rod string may repeatedly contact the tubing string inner wall and result in wear and leakage through the tubing string. In a further example, the components of a PCP are known to wear with use, often the elastomeric inner walls of the stator, with the result that the rotor and stator do not properly seal and there is leakage and loss of pumping efficiency.

Where reduced production indicates a possible downhole equipment failure, various methods and techniques have been developed to assess the downhole situation. One commonly employed technique is pressure testing, in which the pump action is halted and a fluid is injected into the tubing string using a flush-by unit to pressurize the tubing string contents. The flush-by unit is used to pull the rotor out of and above the stator to perform a flush of the tubing string, followed by replacement of the rotor within the stator and then injection of the pressurization fluid. If, after injection, there is more rapid depressurization or pressure release than would normally be expected, or a desired maximum pressurization level cannot be achieved, that is considered to be an indication that there is a failure somewhere in the string—including the pump. The tubing string may have a hole or a break, or there may be a problem at a connection point between tubing string segments. Alternatively, the pump components may have worn down or even become broken. A failure appears to have taken place, but there is no efficient way to confirm where the failure occurred, and thus proper corrective action is difficult to assess.

One technique involves pulling the rod string and rotor and then inserting a "dart" or plug down the tubing string to seat and seal above the pump, in which case the tubing string can be pressure-tested in isolation from the pump, but this involves the expense and costly well down-time involved in running out the rod string and then removing the dart. Electro-magnetic scanning of the tubing string for wear is also technically feasible, but it is generally recognized as being a relatively expensive option, has a significant margin of error and requires removal of the tubing string. As should be clear, then, some testing methods cannot differentiate between tubing string and pump failures, and those that may be able to are generally expensive or undesirably time-consuming.

What is needed, therefore, is a technique that can differentiate between potential tubing string and pump failures without requiring undesirable equipment expense and while reducing well down-time.

SUMMARY OF THE INVENTION

The present invention therefore seeks to provide an apparatus and method for selectively sealing off the PCP to allow tubing string pressure testing, while allowing the rod string to remain in place within the tubing string.

According to a first broad aspect of the present invention, there is provided an apparatus for selectively plugging a tubing string of a fluid producing well above a downhole progressing cavity pump, the pump comprising a rod string assembly comprising a rotor of the pump and a rod string, the rotor depending directly or indirectly from the rod string, the rod string assembly axially moveable within the tubing string, to isolate the pump during tubing string pressure testing, the apparatus comprising:

- a seat member positionable within the tubing string and configured for connection to an inner surface of the tubing string at a point above the pump; and
- a plug member positionable on the rod string assembly and configured for connection to the rod string assembly;
- the seat member comprising a peripheral protuberance defining a centrally-disposed aperture, the aperture for allowing fluid flow therethrough when unobstructed; and
- the plug member configured to seal the aperture and fully obstruct fluid flow therethrough when the plug member is lowered on the rod string assembly to engage the peripheral protuberance.

In some exemplary embodiments of the first aspect, the fluid producing well is an oil producing well, but it may be another type of fluid producing well such as for example a water producing well. The pump preferably comprises a stator connected to a downhole end of the tubing string, and isolating the pump preferably comprises restricting impingement of pressure testing fluid on the pump.

The plug member is preferably configured for connection to the rod string assembly by means selected from the group consisting of clamping, welding, threading and integral manufacturing, and the seat member is preferably configured for connection to the tubing string by means selected from the group consisting of welding, threading and integral manufacturing. The seal between the plug member and the seat member is preferably selected from the group consisting of metal on metal, metal on a readily deformable material, and metal on a composite material. In some exemplary embodiments the deformable surface may comprise a gasket or seating cup.

The peripheral protuberance may comprise any number of specific forms allowing for the desired seal, but in some exemplary embodiments comprises a tapered face for sealing against a corresponding surface of the plug member, or a rounded face for sealing against a corresponding surface of the plug member.

In some embodiments, the apparatus comprises a connector rod for flexibly connecting the plug member and the rotor, to allow the seal despite eccentricity of the rotor central axis relative to the stator central axis.

According to a second broad aspect of the present invention, there is provided a progressing cavity pump isolation assembly for use in a tubing string of a fluid producing well, the assembly comprising:

a seat member positionable within the tubing string and configured for connection to an inner surface of the tubing string at a point above the pump; and a plug member positionable on a rod string assembly, the rod string assembly comprising a rotor and axially moveable within the tubing string, and the plug member configured for connection to the rod string assembly;

the seat member comprising a peripheral protuberance defining a centrally-disposed aperture, the aperture for allowing fluid flow therethrough when unobstructed; and the plug member configured to seal the aperture and fully obstruct fluid flow therethrough and thus isolate the pump when the plug member is lowered on the rod string assembly to engage the peripheral protuberance.

In some exemplary embodiments of the second aspect, the fluid producing well is an oil producing well, but it may be another type of fluid producing well such as for example a water producing well. The pump preferably comprises a stator connected to a downhole end of the tubing string, and isolating the pump preferably comprises restricting impingement of injected fluid on the pump.

The plug member is preferably configured for connection to the rod string assembly by means selected from the group consisting of clamping, welding, threading and integral manufacturing, and the seat member is preferably configured for connection to the tubing string by means selected from the group consisting of welding, threading and integral manufacturing. The seal between the plug member and the seat member is preferably selected from the group consisting of metal on metal, metal on a readily deformable material, and metal on a composite material.

The peripheral protuberance may comprise any number of specific forms allowing for the desired seal, but in some exemplary embodiments comprises a tapered face for sealing against a corresponding surface of the plug member, or a rounded face for sealing against a corresponding surface of the plug member.

In some embodiments, the assembly comprises a connector rod for flexibly connecting the plug member and the rotor, to allow the seal despite eccentricity of the rotor central axis relative to the stator central axis.

According to a third broad aspect of the present invention, there is provided a progressing cavity pump isolation system for use in tubing string pressure testing, the system comprising:

a fluid producing well;

a tubing string disposed within the fluid producing well;

a progressing cavity pump comprising a rotor, the rotor part of a rod string assembly axially moveable within the tubing string;

a seat member connected to an inner surface of the tubing string at a point above the pump; and a plug member connected to the rod string assembly above the seat member;

the seat member comprising a peripheral protuberance defining a centrally-disposed aperture, the aperture for allowing fluid flow therethrough when unobstructed; and the plug member configured to seal the aperture and fully obstruct fluid flow therethrough when the plug member is lowered on the rod string assembly to engage the peripheral protuberance, thus isolating the pump for pressure testing of the tubing string above the plug member.

In some exemplary embodiments of the third aspect, the fluid producing well is an oil producing well, but it may be another type of fluid producing well such as for example a water producing well. The pump preferably comprises a stator connected to a downhole end of the tubing string, and isolating the pump preferably comprises restricting impingement of injected fluid on the pump.

The plug member is preferably configured for connection to the rod string assembly by means selected from the group consisting of clamping, welding, threading and integral manufacturing, and the seat member is preferably configured for connection to the tubing string by means selected from the group consisting of welding, threading and integral manufacturing. The seal between the plug member and the seat member is preferably selected from the group consisting of metal on metal, metal on a readily deformable material, and metal on a composite material.

The peripheral protuberance may comprise any number of specific forms allowing for the desired seal, but in some exemplary embodiments comprises a tapered face for sealing against a corresponding surface of the plug member, or a rounded face for sealing against a corresponding surface of the plug member.

In some embodiments, the system comprises a connector rod for flexibly connecting the plug member and the rotor, to allow the seal despite eccentricity of the rotor central axis relative to the stator central axis.

According to a fourth broad aspect of the present invention, there is provided a method for pressure testing a tubing string in a fluid production well, the tubing string comprising a downhole progressing cavity pump, the pump comprising a rotor, the rotor part of an axially moveable rod string assembly within the tubing string, the method comprising the steps of:

a. providing a seat member on an inner surface of the tubing string above the pump, the seat member comprising a peripheral protuberance defining a centrally-disposed aperture;
b. providing a plug member on the rod string assembly above the seat member, the plug member moveable between a raised position in which the aperture is unobstructed by the plug member, and a lowered position in which the plug member seals and fully obstructs the aperture;
c. positioning the plug member in the raised pump operation position and operating the pump to produce a production fluid through the aperture and up the tubing string;
d. ceasing operation of the pump;
e. lowering the rod string assembly to the lowered position such that the plug member engages and seals the aperture, thus fully obstructing flow downwardly through the aperture;
f. injecting a tubing string pressure testing fluid from surface down the tubing string;
g. allowing pressurization of the tubing string pressure testing fluid within the tubing string; and
h. measuring the pressurization.

In some exemplary embodiments of the fourth aspect, the method further comprises the following steps between steps d. and e.: injecting a well pressure testing fluid from surface down the tubing string; allowing pressurization of the well pressure testing fluid within the tubing string and the pump; and measuring the pressurization.

Exemplary methods may further comprise, between steps b. and c., the step of lowering the rod string assembly until the plug member engages the seat member, thus locating the rotor at a desired location within the pump.

The step of measuring the pressurization preferably comprises measuring the quantum of the pressurization of the tubing string pressure testing fluid and/or measuring the period and rate over which the pressurization releases.

According to a fifth broad aspect of the present invention, there is provided a method for isolating a downhole progressing cavity pump for a tubing string pressure test, the pump comprising a rotor, the rotor part of an axially moveable rod string assembly within the tubing string, the method comprising the steps of:

a. providing a seat member on an inner surface of the tubing string above the pump, the seat member comprising a peripheral protuberance defining a centrally-disposed aperture;
b. providing a plug member on the rod string assembly above the seat member, the plug member moveable between a raised position in which the aperture is unobstructed by the plug member, and a lowered position in which the plug member seals and fully obstructs the aperture;
c. positioning the plug member in the raised position and operating the pump to produce a production fluid through the aperture and up the tubing string;
d. ceasing operation of the pump;
e. lowering the rod string assembly to the lowered position such that the plug member engages and seals the aperture, thus fully obstructing flow of fluid downwardly through the aperture and isolating the pump;
f. injecting a tubing string pressure testing fluid from surface down the tubing string;
g. allowing pressurization of the tubing string pressure testing fluid within the tubing string above the plug member; and
h. measuring the pressurization.

In some exemplary embodiments of the fifth aspect, the method further comprises the following steps between steps d. and e.: injecting a well pressure testing fluid from surface down the tubing string; allowing pressurization of the well pressure testing fluid within the tubing string and the pump; and measuring the pressurization.

Some exemplary methods further comprise, between steps b. and c., the step of lowering the rod string assembly until the plug member engages the seat member, thus locating the rotor at a desired location within the pump.

The step of measuring the pressurization preferably comprises measuring the quantum of the pressurization of the tubing string pressure testing fluid and/or measuring the period and rate over which the pressurization releases.

Isolating the pump preferably comprises restricting impingement of the tubing string pressure testing fluid on the pump.

According to a sixth broad aspect of the present invention, there is provided a method for progressing cavity pump failure testing, the pump located at a downhole end of a tubing string within a fluid production well, the pump comprising a rotor, the rotor part of an axially moveable rod string assembly within the tubing string, the method comprising the steps of:

a. providing a seat member on an inner surface of the tubing string above the pump, the seat member comprising a peripheral protuberance defining a centrally-disposed aperture;
b. providing a plug member on the rod string assembly above the seat member, the plug member moveable between a raised position in which the aperture is unobstructed by the plug member, and a lowered position in which the plug member seals and fully obstructs the aperture;
c. operating the pump to produce a production fluid;
d. detecting a deficient fluid production from the well indicative of a downhole equipment failure;
e. ceasing operation of the pump;
f. lowering the rod string assembly to the lowered position such that the plug member engages and seals the aperture, thus fully obstructing flow of fluid downwardly through the aperture and isolating the pump;
g. injecting a tubing string pressure testing fluid from surface down the tubing string;
h. allowing pressurization of the tubing string pressure testing fluid within the tubing string above the plug member;
i. measuring the pressurization; and
j. determining whether the pressurization indicates a potential tubing string failure or a potential pump failure.

In some exemplary embodiments of the sixth aspect, the method further comprises the following steps between steps e. and f.: injecting a well pressure testing fluid from surface down the tubing string; allowing pressurization of the well pressure testing fluid within the tubing string and the pump; and measuring the pressurization.

Exemplary methods may further comprise, between steps b. and c., the steps of lowering the rod string assembly until the plug member engages the seat member, thus locating the rotor at a desired location within the pump, and raising the rod string assembly to the raised position.

The step of measuring the pressurization preferably comprises measuring the quantum of the pressurization of the tubing string pressure testing fluid and/or measuring the period and rate over which the pressurization releases.

Isolating the pump preferably comprises restricting impingement of the tubing string pressure testing fluid on the pump.

The step of determining whether the pressurization indicates a potential tubing string failure or a potential pump failure preferably comprises determining whether the pressurization is within normal parameters, pressurization within normal parameters indicating a potential failure of the pump that was isolated during pressurization.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention:

FIGS. 7*a* to 7*d* are various views illustrating an embodiment comprising a plug member and seat member having a rounded interface;

Exemplary embodiments of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the invention to the precise forms of any exemplary embodiment. Accordingly, the description and drawings are to be regarded in an illustrative, rather than a restrictive, sense.

The present invention relates to techniques and apparatuses for pressure testing a tubing string of a fluid production well, the tubing string being provided with a progressing cavity pump at a downhole end, to help determine whether the tubing string has failed or the pump has failed. Apparatuses according to the present invention comprise a plug member connected to the rod string assembly that comprises the pump rotor, such that the rod string assembly can be lowered to seat the plug member in a seat member within the tubing string above the pump, thus sealing off and isolating the pump from the rest of the tubing string, allowing pressure testing of the tubing string above the pump.

Figure 1:
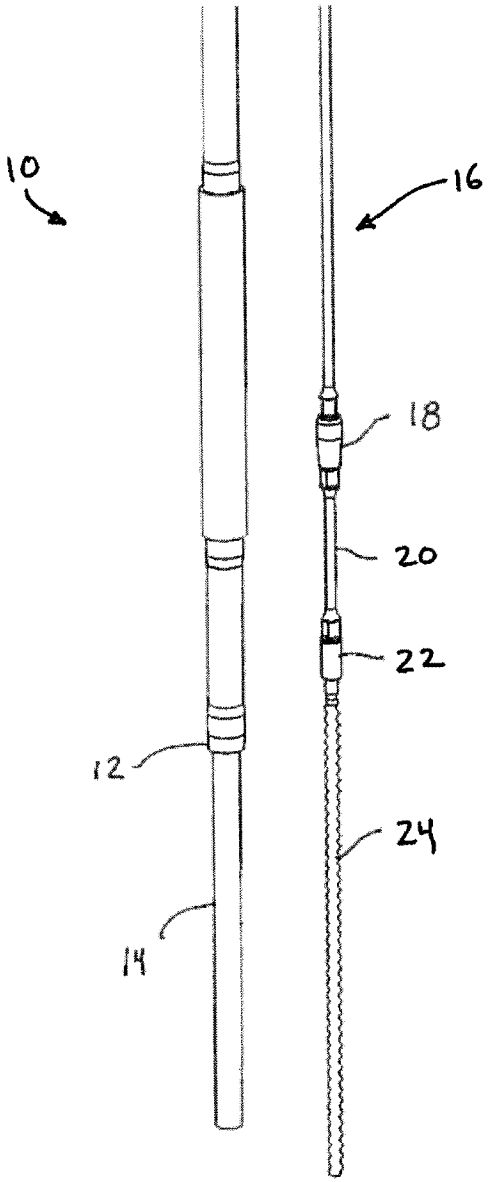
FIG. 1 is a perspective view of a tubing string with stator and a rod string with rotor, in accordance with an embodiment of the present invention.
Figure 2:
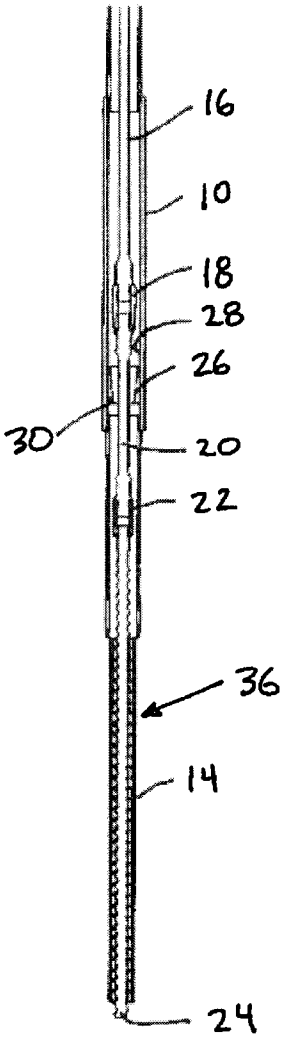
FIG. 2 is a sectional view of the rod string and tubing string of FIG. 1, with the rotor positioned in the stator and the assembly in the pump operating position.
Figure 3:
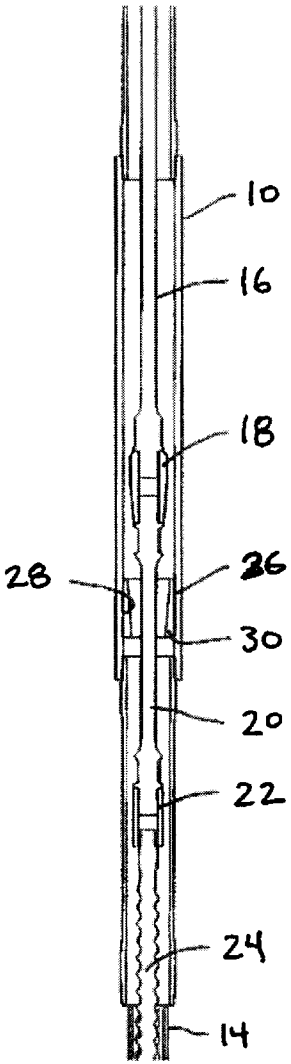
FIG. 3 is a detailed section view showing the plug member and the seat member.

Turning to FIGS. 1 to 3, an exemplary embodiment of the present invention is illustrated. The exemplary embodiment comprises a tubing string 10 and a rod string 16, the rod string 16 configured for axial and rotational movement within the tubing string 10 in a manner familiar to those skilled in the art. The tubing string 10 is connected at its downhole end 12 to a stator 14 of a progressing cavity pump 36. The stator 14 comprises an inner double helix cavity for receiving a single helix rotor 24, in a conventional manner. The rod string 16 may be primarily made up of sucker rods or continuous rod. The rotor 24 is connected to the rod string 16, which rod string 16 is driven at surface by drive means known to those skilled in the art, rotating to impart rotation to the rotor 24 to pump fluids upwardly through the pump 36. The operation of a progressing cavity pump is well known to those skilled in the art and will thus not be described in any further detail.

A plug member 18 is connected to the rod string 16 at a location upwardly spaced from the rotor 24. The rod string 16 connects to a top end of the plug member 18, while a connector rod 20 connects to a bottom end of the plug member 18. As the central axis of the rotor 24 is eccentric or offset from the central axis of the stator 14, the connector rod 20 may be required in the view of a skilled person to provide a flexible connection to ensure that the seal between the plug member 18 and the seat member 26 is possible. The connector rod 20 in turn connects to a rod box connection 22 which connects to the rotor 24 to impart the rotation from the rod string 16.

Note that while the plug member 18 is shown as connected to the rod string 16 in the illustrated embodiment, it could be connected to another component of the rod string assembly where appropriate and desirable. For example, the rod string assembly may comprise a rod box connection (for connecting rods and the rotor or other components together), a sucker rod (a single segment of a rod string), a connector rod (a shorter version of a sucker rod), a rod shear (a component designed to break under a certain defined tension), a rod centralizer (which centralizes a rod string within a tubing string), and a rotor, and the plug member can be connected or integral to any of these where determined to be appropriate and desirable by a person skilled in the art having reference to the within teaching.

FIGS. 2 and 3 illustrate sectional views of the exemplary embodiment. In these Figures a seat member 26 is shown, which seat member 26 connects to the inner wall 28 of the tubing string 10 in any appropriate conventional manner, including without limitation welding, threading, integral manufacturing or a custom component. While shown as connected to a larger-diameter tubing component allowing coilability, the present invention is not to be construed as being limited to this embodiment. The seat member 26 comprises a peripheral protuberance 30, which in the illustrated embodiment is a ring-shaped insert having a wedge-shaped cross-section, the wedge widening in a downhole direction to receive and retain the plug member 18, as described below.

Note that while the seat member 26 is shown as connected to the inner wall 28 of the tubing string 10 in the illustrated embodiment, it could be connected to another component of the tubing string where appropriate and desirable. For example, the seat member could be connected to a joint of tubing, a tubing pup joint (a shorter version of a standard tubing joint), a tubing drain (a component designed to burst open when enough hydraulic pressure is applied to allow fluid to drain from the tubing above the pump), or the stator itself, where determined to be appropriate and desirable by a person skilled in the art having reference to the within teaching.

The peripheral protuberance 30 defines an internally disposed aperture 32, through which fluids may pass when unobstructed. FIGS. 4*a* through 5*b* illustrate these and other features in greater detail.

Figure 4A:
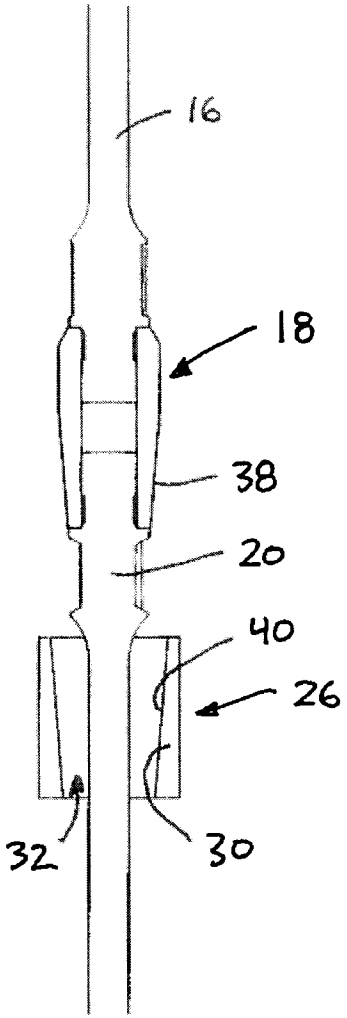
FIG. 4*a* is a detailed section view of the plug member and the seat member, in the pump operating position.
Figure 4B:
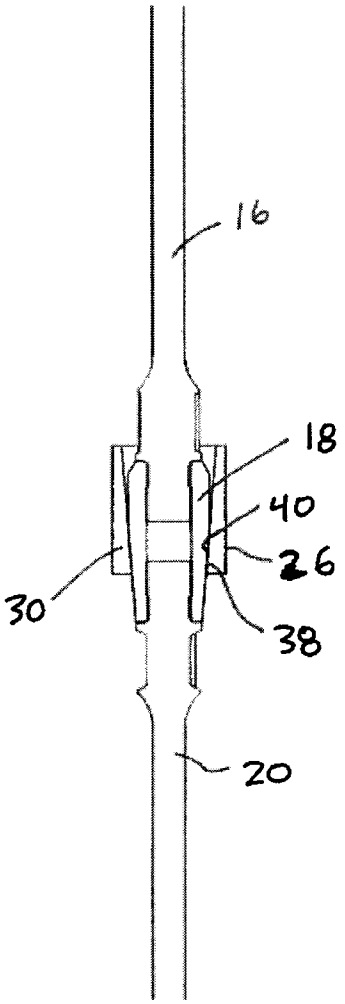
FIG. 4*b* is a detailed section view of the plug member and the seat member, in the pressure testing position.

FIGS. 4*a* and 4*b* illustrate certain details of the first embodiment without the tubing string 10 environment. The plug member 18 receives a downstream end of the rod string 16 and an upstream end of the connector rod 20 (which connector rod 20 may not be required in all embodiments of the present invention). The plug member 18 also comprises a sealing surface 38 which is configured to seal against a corresponding sealing surface 40 of the seat member 26, as described below. The seat member 26 comprises the peripheral protuberance 30 and the aperture 32, and the peripheral protuberance 30 is provided with the sealing surface 40 of the seat member 26.

FIG. 4*a* illustrates the exemplary embodiment in the raised or pump operation position, in which the plug member 18 is disengaged from the seat member 26, thus keeping the aperture 32 open and unobstructed to allow fluid flow through the aperture 32 during operation of the pump 36. FIG. 4*b* illustrates the exemplary embodiment in the lowered or pressure testing position, in which the plug member 18 engages the seat member 26, the sealing surfaces 38, 40 pressed together to seal the aperture 32, as will be described in detail below.

Figure 5A:
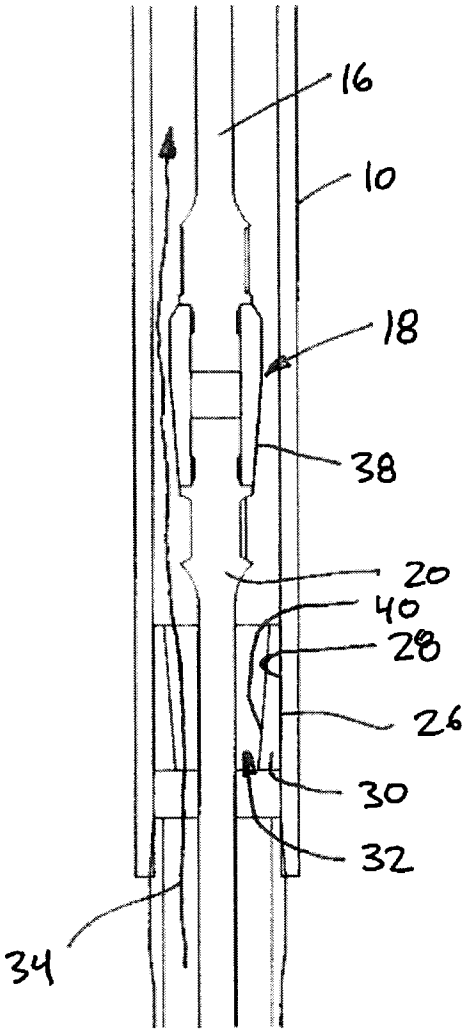
FIG. 5*a* is a detailed section view of the plug member and the seat member, in the pump operating position, with the tubing string environment.
Figure 5B:
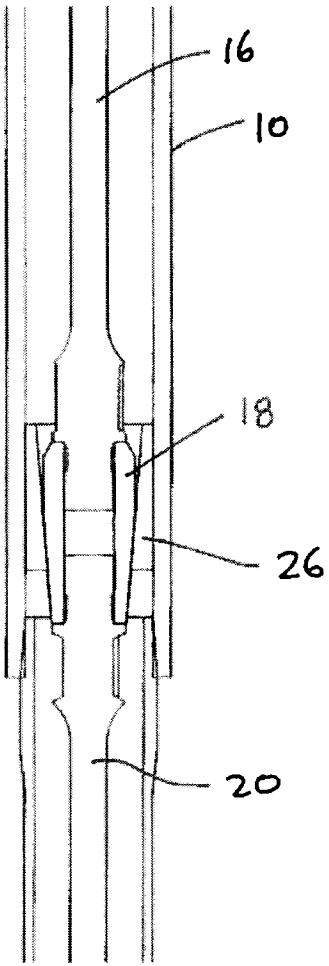
FIG. 5*b* is a detailed section view of the plug member and the seat member, in the pressure testing position, with the tubing string environment.

FIGS. 5*a* and 5*b* illustrate the same features as in FIGS. 4*a* and 4*b*, but with the tubing string 10 environment. FIG. 5*a* illustrates the flow path 34 for the produced fluid, as the produced fluid can move upwardly through the aperture 32, around the plug member 18 and upwardly in the tubing string 10. This is the position of the plug member 18 when an operator desires to use the pump 36 to move fluid to surface through the tubing string 10. When an operator wishes to isolate the tubing string 10 from the pump 36 for a pressure test, pump 36 operation is ceased and the rod string 16 is lowered to seat the plug member 18 in the seat member 26, as shown in FIG. 5*b*, thus blocking the flow path for produced fluid that was open in FIG. 5*a*.

The sealing interface between the plug member 18 and the seat member 26 can take various forms. For the purposes of illustration, four alternative embodiments are shown and described below. Note that the illustrated plug member designs incorporate an uphole tapered surface, which is intended for ease of rod string retrieval. Also, plug members according to the present invention could incorporate a combination of the sealing interfaces described below and illustrated herein.

Turning now to FIGS. 6*a* to 6*e*, a first sealing interface arrangement is illustrated. In these Figures, a tapered sealing interface is shown. The plug member 18 comprises a conically tapered sealing surface 42 which tapers inwardly in a downhole direction. This sealing surface 42 is configured to mate with a corresponding tapered sealing surface 44 on the peripheral protuberance 30, which sealing surface 44 can be seen in dashed lines in FIG. 6*a*, which illustrates this embodiment in the raised or pump operating position with the plug member 18 disengaged from the seat member 26.

Figure 6A:
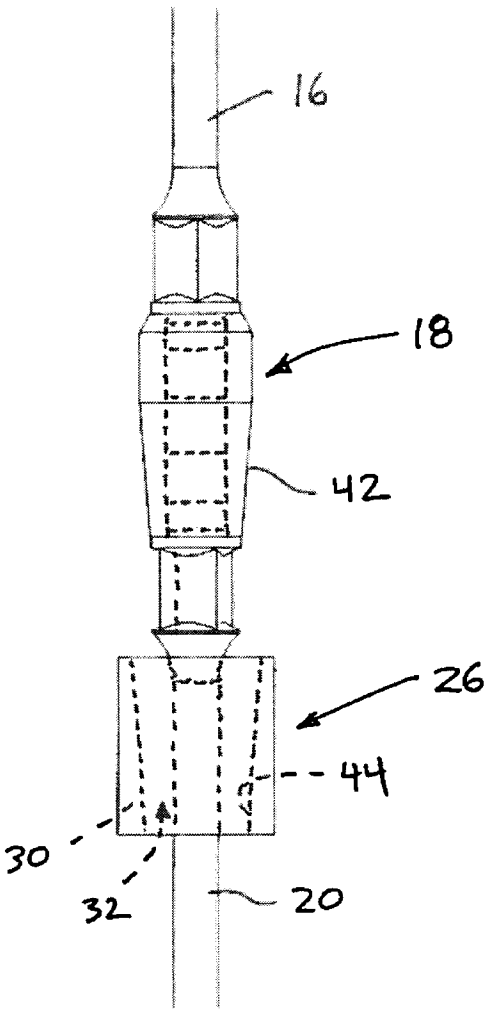
FIGS. 6*a* to 6*e* are various views illustrating an embodiment comprising a plug member and seat member having a tapered interface.
Figure 6B:
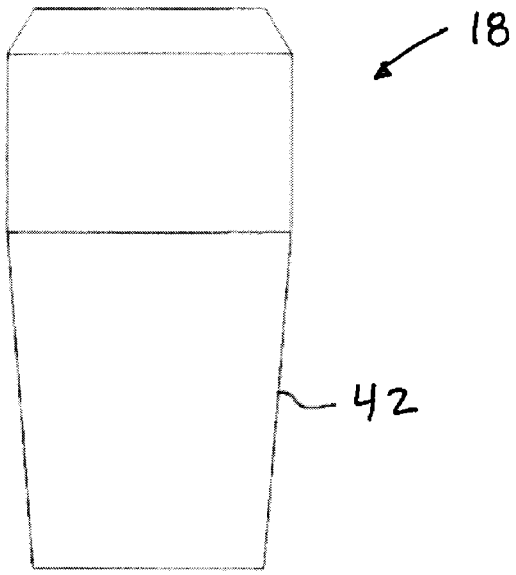
Figure 6C:
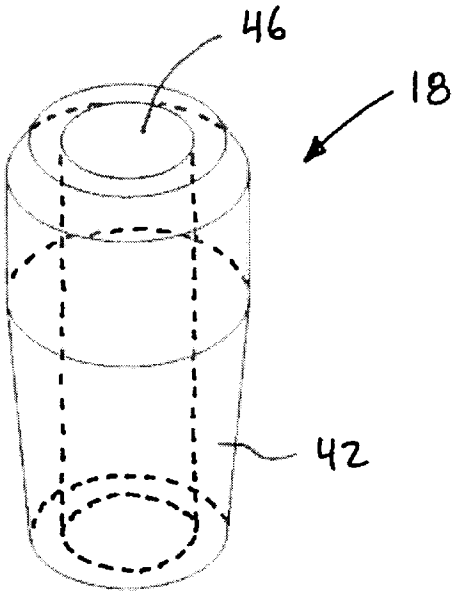

FIGS. 6*b* and 6*c* illustrate this embodiment of the plug member 18 in detail. The plug member 18 comprises the tapered sealing surface 42, and also an inner bore 46 for receiving the rod string 16 in an upper end and the connector rod 20 in a lower end. Again, the present invention is not limited to a threaded connection of a plug member to a rod string.

Figure 6D:
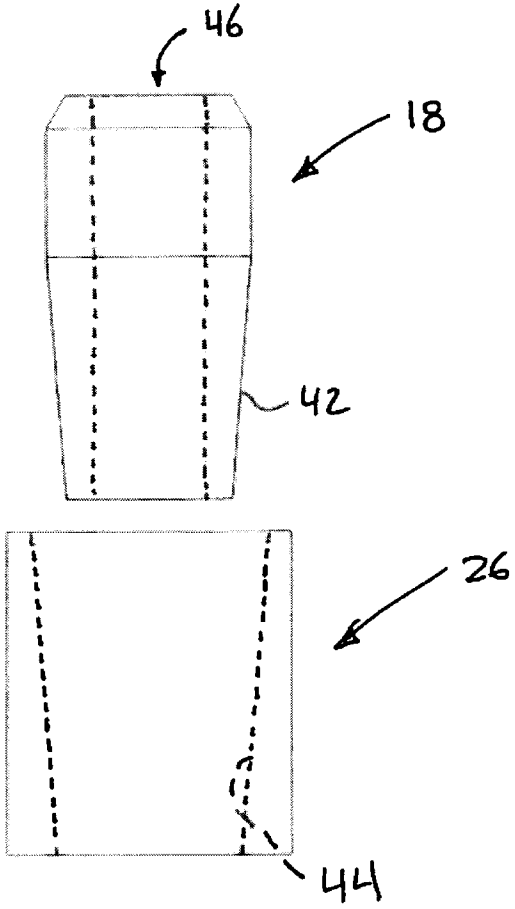
Figure 6E:
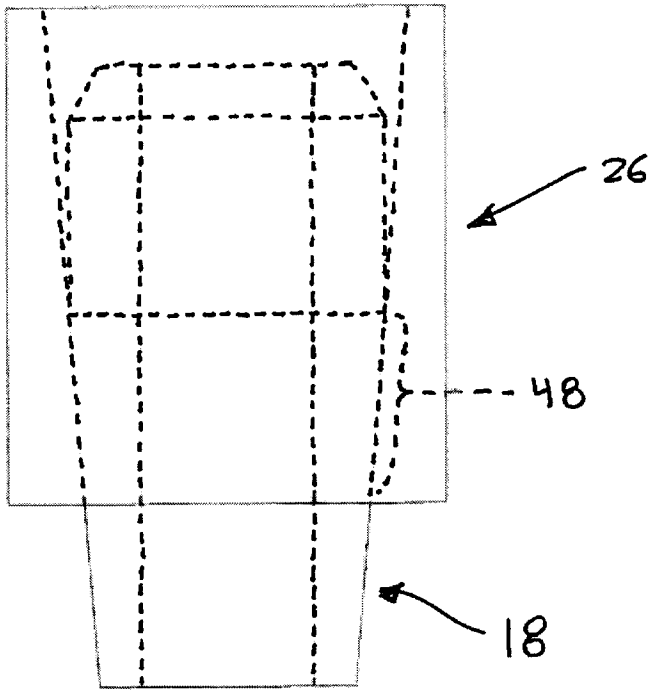

FIGS. 6*d* and 6*e* illustrate the plug member 18 and the seat member 26 in accordance with this embodiment, with the plug member 18 comprising the sealing surface 42 and the seat member 26 comprising the corresponding sealing surface 44. FIG. 6*d* illustrates the plug member 18 disengaged from the seat member 26, while FIG. 6*e* illustrates the plug member 18 engaged with the seat member 26. As can be seen in FIG. 6*e*, a portion of the sealing surface 42 seals against a portion of the sealing surface 44 when the plug member 18 is fully inserted within the seat member 26, creating a sealed interface 48. While this may be a metal on metal seal, it is also obviously possible to provide one or more gaskets or sealing rings to enhance the seal, or make either or both of the plug member 18 and the seat member 26 out of an elastomeric or composite material or coat same with an elastomeric or composite material. By thus sealing the components and obstructing the aperture 32, a pressure test can be run on the tubing string 10, as described below.

Turning now to FIGS. 7*a* to 7*d*, a second sealing interface arrangement is illustrated. In this embodiment, a rounded sealing interface is shown. The plug member 18 comprises a convex rounded sealing surface 50 which is disposed in a downhole direction. This sealing surface 50 is configured to mate with a corresponding concave rounded sealing surface 52 on the peripheral protuberance 30, which sealing surface 52 can be seen in dashed lines in FIG. 7*a*, which illustrates this embodiment in the raised or pump operating position with the plug member 18 disengaged from the seat member 26.

The plug member 18 comprises the rounded sealing surface 50, and also an inner bore 54 for receiving the rod string 16 in an upper end and the connector rod 20 in a lower end.

Figure 7A:
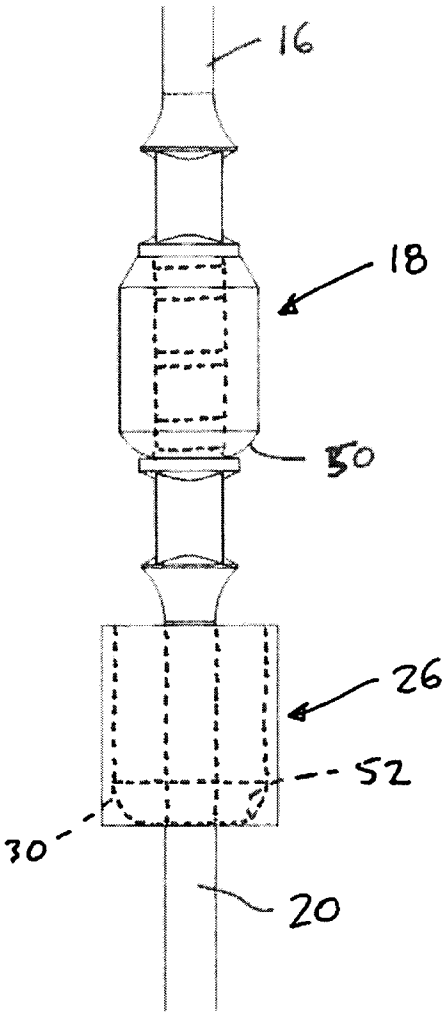
Figure 7B:
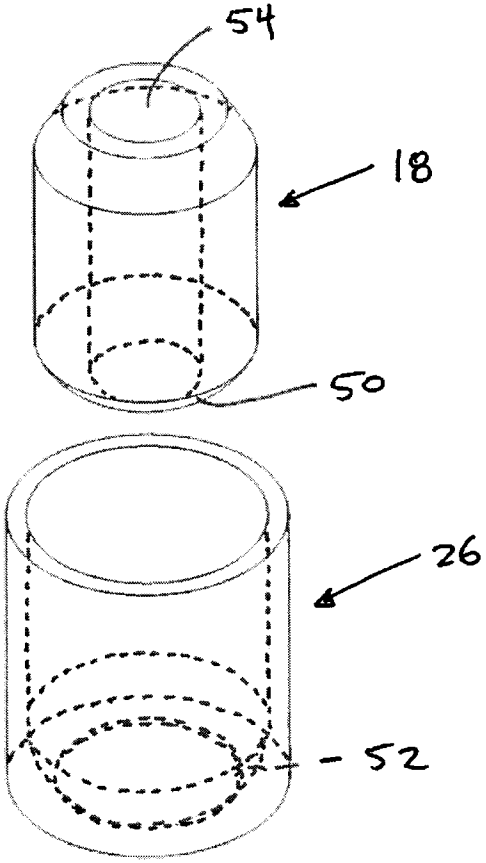
Figure 7C:
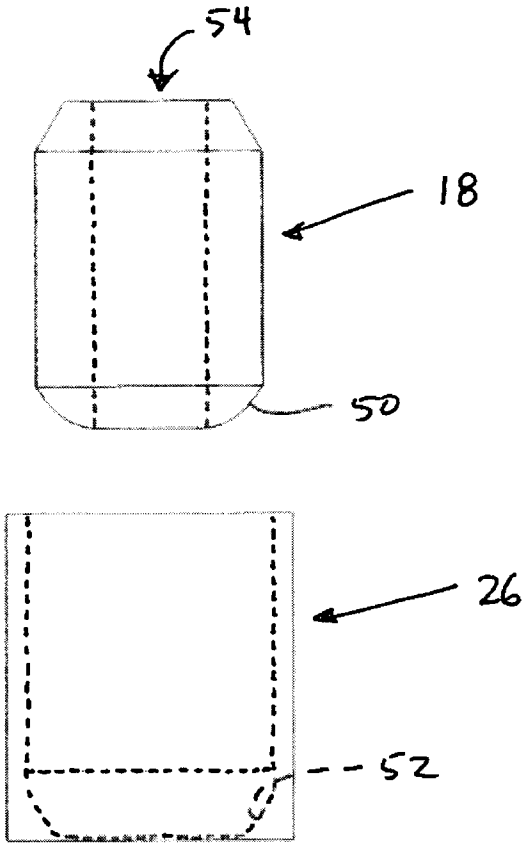
Figure 31A:
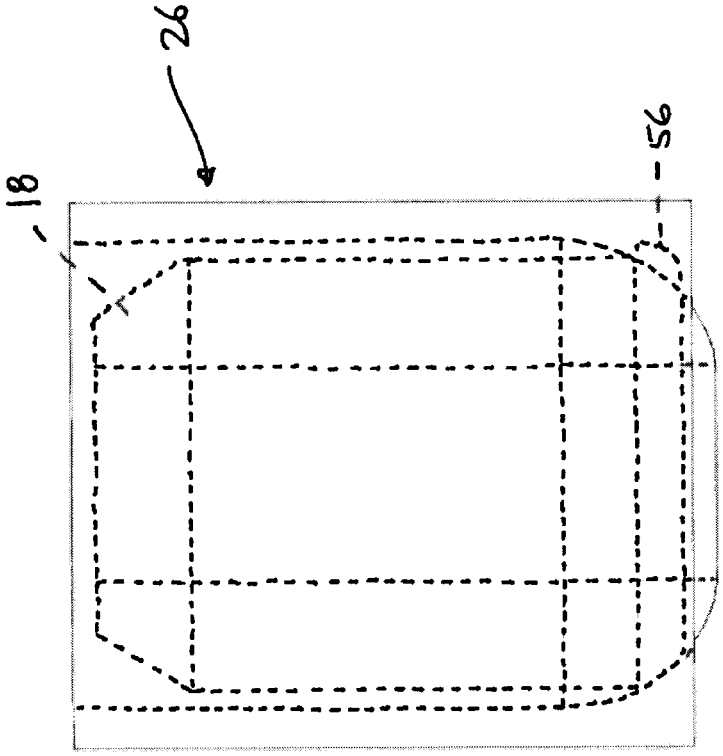

FIGS. 7*b* to 7*d* illustrate the plug member 18 and the seat member 26 in accordance with this embodiment, with the plug member 18 comprising the sealing surface 50 and the seat member 26 comprising the corresponding sealing surface 52. FIGS. 7*b* and 7*c* illustrate the plug member 18 disengaged from the seat member 26, while FIG. 7*d* illustrates the plug member 18 engaged with the seat member 26. As can be seen in FIG. 7*d*, a portion of the sealing surface 50 seals against a portion of the sealing surface 52 when the plug member 18 is fully inserted within the seat member 26, creating a sealed interface 56.

Turning now to FIGS. 8*a* to 8*d*, a third sealing interface arrangement is illustrated. In this embodiment, a horizontal shoulder sealing interface is shown. The plug member 18 comprises a horizontal shoulder as sealing surface 58 which faces in a downhole direction. This sealing surface 58 is configured to mate with a corresponding upwardly facing shoulder as sealing surface 60 on the peripheral protuberance 30, which sealing surface 60 can be seen in dashed lines in FIG. 8*a*, which illustrates this embodiment in the raised or pump operating position with the plug member 18 disengaged from the seat member 26.

Figure 8A:
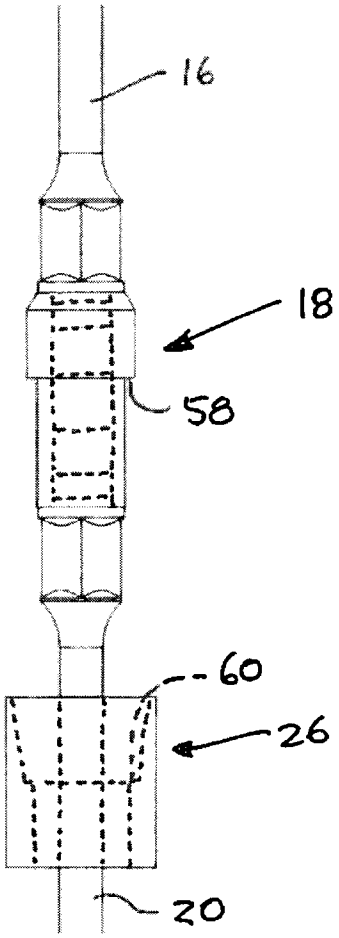
FIGS. 8*a* to 8*d* are various views illustrating an embodiment comprising a plug member and seat member having an overlapping shoulder interface.
Figure 8B:
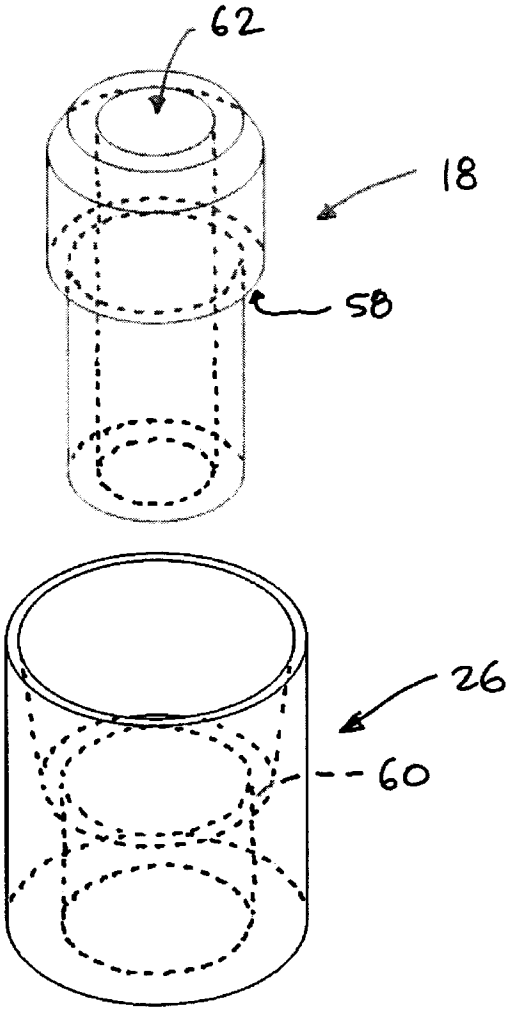

The plug member 18 comprises the downwardly facing sealing surface 58, and also an inner bore 62 as can be seen in FIG. 8*b* for receiving the rod string 16 in an upper end and the connector rod 20 in a lower end.

Figure 8C:
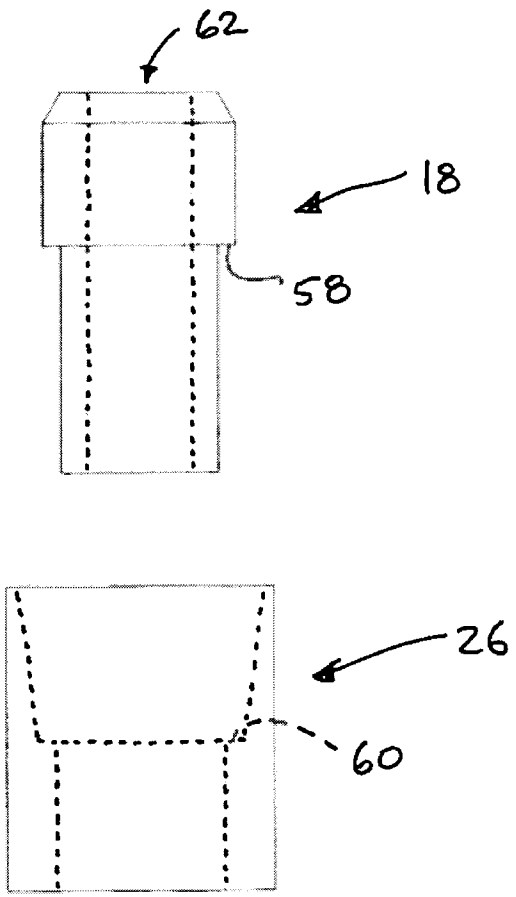
Figure 8D:
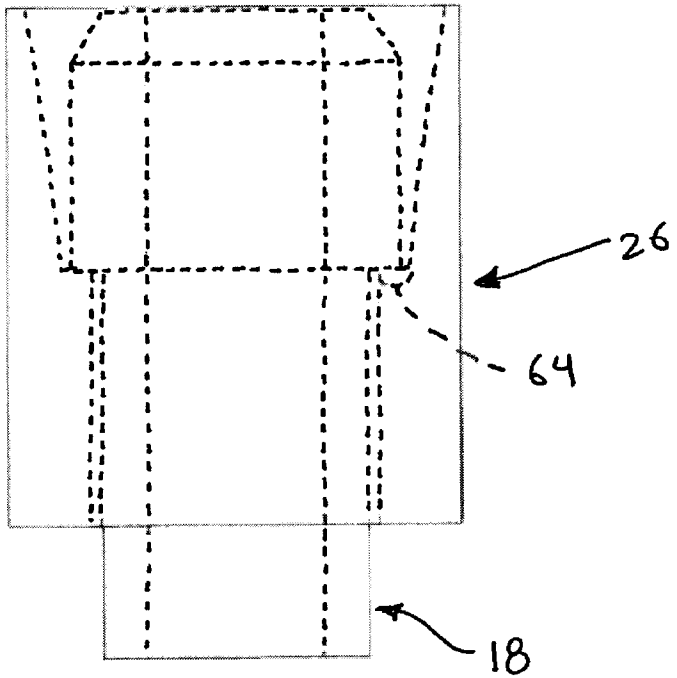

FIGS. 8*b* to 8*d* illustrate the plug member 18 and the seat member 26 in accordance with this embodiment, with the plug member 18 comprising the sealing surface 58 and the seat member 26 comprising the corresponding sealing surface 60. FIGS. 8*b* and 8*c* illustrate the plug member 18 disengaged from the seat member 26, while FIG. 8*d* illustrates the plug member 18 engaged with the seat member 26. As can be seen in FIG. 8*d*, a portion of the sealing surface 58 seals against a portion of the sealing surface 60 when the plug member 18 is fully inserted within the seat member 26, creating a sealed interface 64.

Turning now to FIGS. 9*a* to 9*e*, a fourth sealing interface arrangement is illustrated. In this embodiment, a vertical sealing interface is shown. The plug member 18 comprises a vertical sealing surface 66. This sealing surface 66 is configured to mate with a corresponding vertical sealing surface 68 on the peripheral protuberance 30, which sealing surface 68 can be seen in dashed lines in FIGS. 9*a* and 9*b*, which illustrates this embodiment in the raised or pump operating position with the plug member 18 disengaged from the seat member 26.

Figure 9A:
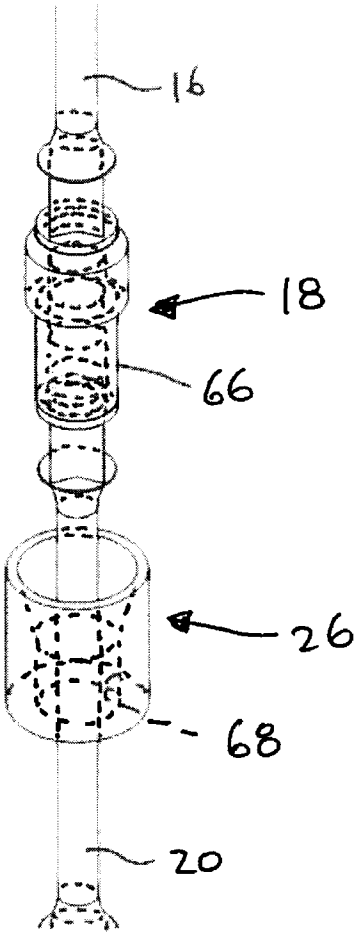
FIGS. 9*a* to 9*e* are various views illustrating an embodiment comprising a plug member and seat member having a vertical interface.
Figure 9B:
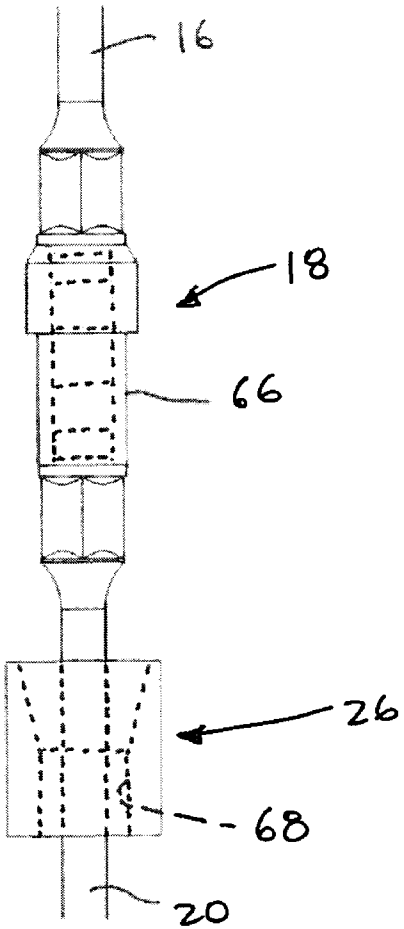
Figure 9C:
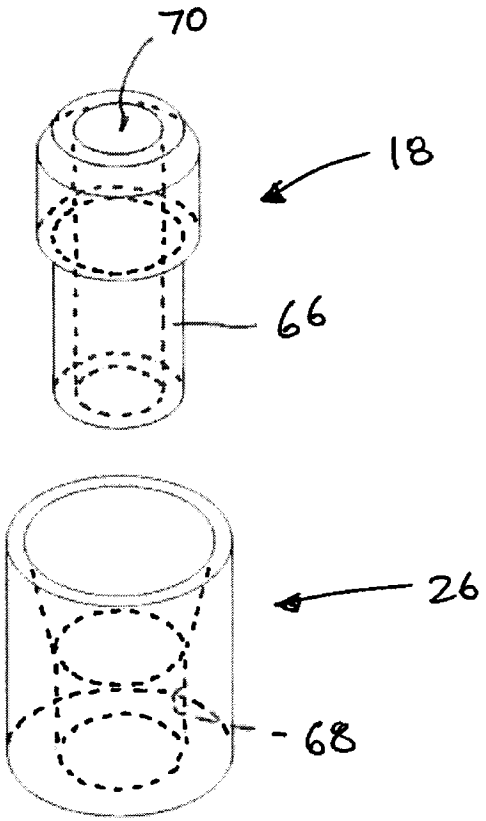
Figure 9D:
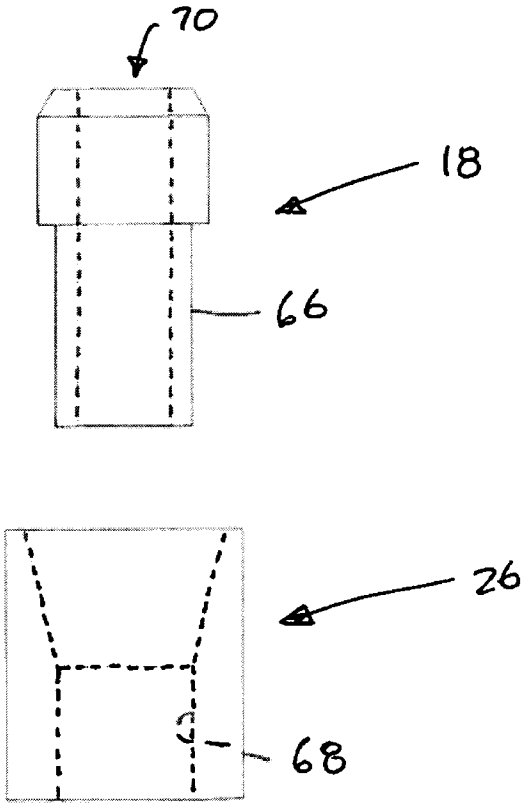

The plug member 18 comprises the sealing surface 66, and also an inner bore 70 as can be seen in FIGS. 9*c* and 9*d* for receiving the rod string 16 in an upper end and the connector rod 20 in a lower end.

Figure 9E:
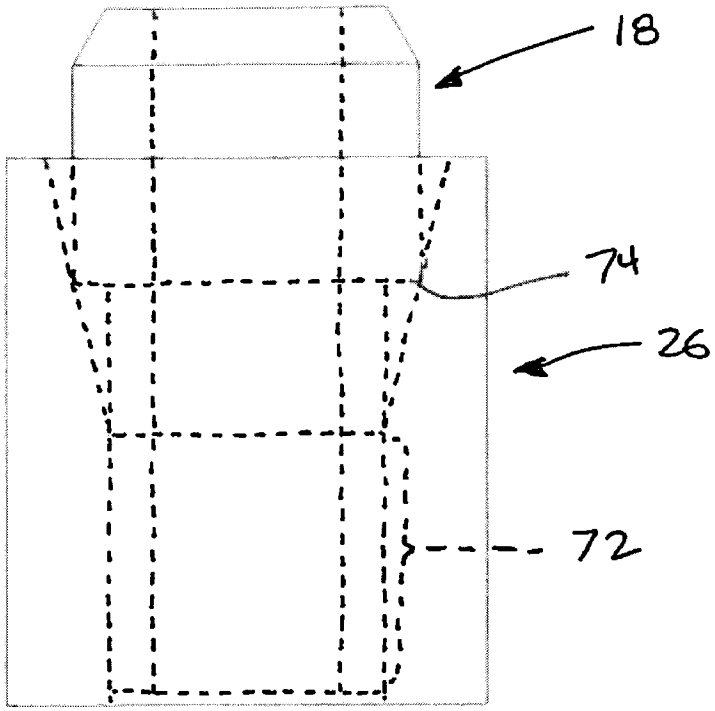

FIGS. 9*c* to 9*e* illustrate the plug member 18 and the seat member 26 in accordance with this embodiment, with the plug member 18 comprising the sealing surface 66 and the seat member 26 comprising the corresponding sealing surface 68. FIGS. 9*c* and 9*d* illustrate the plug member 18 disengaged from the seat member 26, while FIG. 9*e* illustrates the plug member 18 engaged with the seat member 26. As can be seen in FIG. 9*e*, a portion of the sealing surface 66 seals against a portion of the sealing surface 68 when the plug member 18 is fully inserted within the seat member 26, creating a sealed interface 72, and an engagement edge 74 of the plug member 18 contacts the seat member 26, thus restricting further downward movement of the plug member 18. While not shown, it will be obvious that additional sealing components such as gaskets, hold down or seating rings can be employed to enhance the seal.

While the illustrated embodiments show the plug member receiving the rod string and connector rod within bores in the plug member, other connection means can be used and would be clear to those skilled in the art having recourse to the within teaching. Also, the plug member may be positioned at other points on the rod string, for example connecting two rod ends. In further examples, the plug member could connect the rod string to a shear coupling or could be integral to the shear coupling in the rod string. The plug member integral to any appropriate rod component including centralizers, and it could even be integral to the rotor in appropriate designs.

Further, while the illustrated embodiments show the seat member connected to an inner surface of the tubing string at a point above the pump, the seat member can be connected to or integral with a tubing joint, a tubing collar, a drain or the stator.

Having described exemplary embodiments of an apparatus, assembly and system in accordance with the present invention, exemplary embodiments of methods according to the present invention will now be described with reference to the accompanying drawings.

Figure 10:
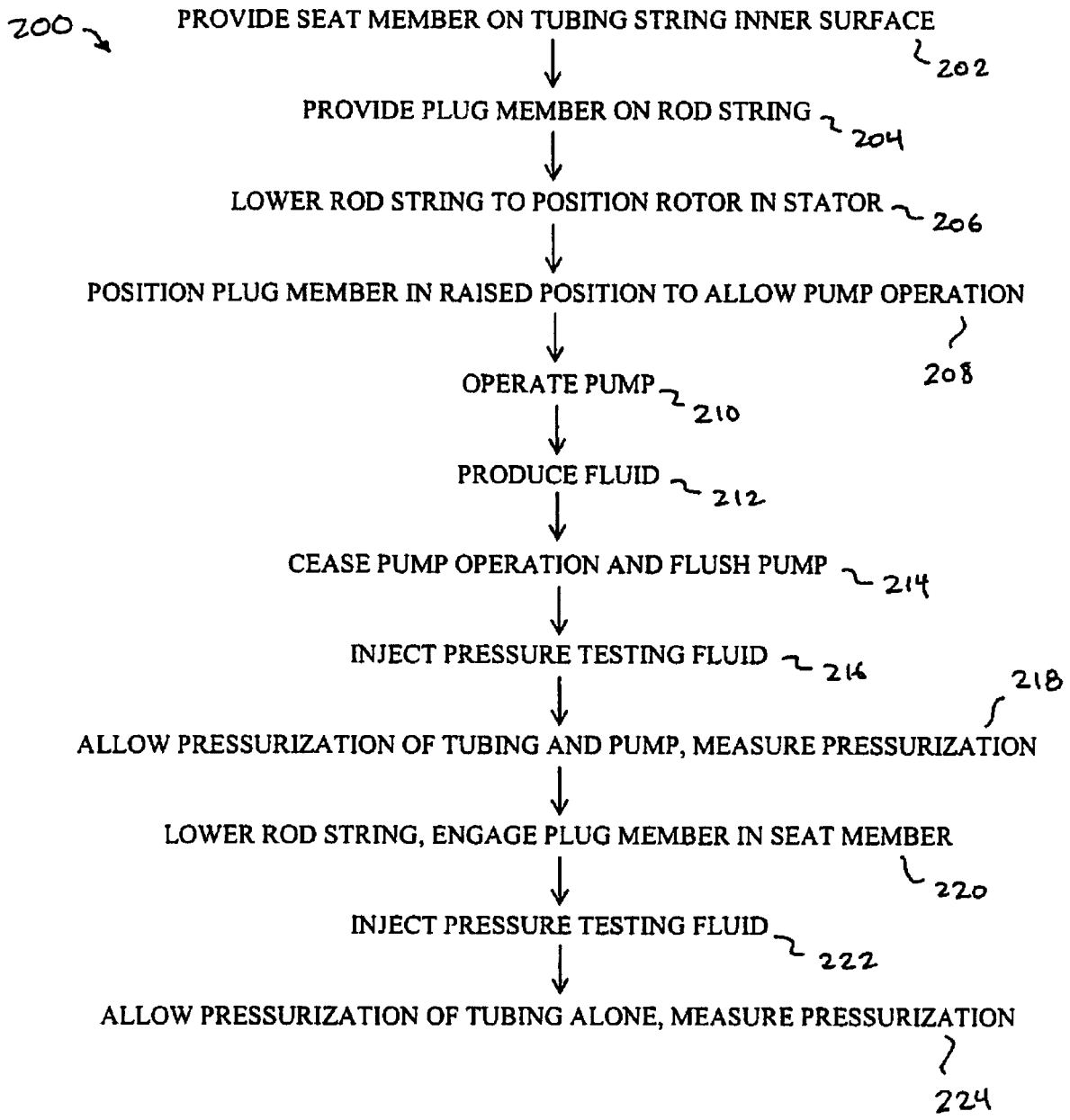
FIG. 10 is a flowchart illustrating an exemplary method in accordance with an embodiment of the present invention.

Turning now to FIG. 10, an exemplary method 200 is illustrated. This method 200 allows for both pressure testing of a tubing string and for isolating a downhole PCP. The method 200 commences with the provision of a seat member on the tubing string inner surface at step 202 and the provision of a plug member on the rod string above the seat member at step 204, as described above. After the tubing string has been lowered into the well with the PCP stator at its lower end, the rod string is lowered within the tubing string at step 206 to position the rotor within the stator cavity. The location of the seat member may optionally be determined such that once the plug member fully engages the seat member the rod string is blocked from further downward movement and the rotor is placed thereby in a desired location within the stator cavity; the rod string would then be pulled up some set distance (a "space out") to ensure a desired rod string tension. At step 208 the rod string is pulled upwardly to lift the plug member into the raised or pump operation position, disengaged from the seat member. The PCP can then be operated at step 210 and fluid can be produced at step 212.

When it is desired to pressure test the tubing string or isolate the pump for any reason, the method 200 continues by ceasing operation of the pump and flushing the pump (pulling the rotor from the stator and allowing fluid to drain through the stator) at step 214, and running an initial pressurization test using a flush-by unit in an effort to pressurize the system. This initial pressurization test involves injecting a pressure testing fluid down the tubing string to the pump at step 216, and allowing pressurization within the tubing string and pump at step 218. Note that at this stage the pump has not been isolated. The quantum of pressurization can be measured, as can the time it takes for the pressurization to decline after injection ceases. If the pressurization is measured to be less than should be expected under normal circumstances with the downhole equipment in good operating condition, or the pressurization declines more rapidly than should be the case, this indicates a potential failure somewhere in the tubing string or the pump.

At step 220, isolation of the pump is undertaken as a way to clarify the location of the potential failure. The rod string is lowered to the pressure testing position such that the plug member engages and seals the aperture, thus fully obstructing flow downwardly through the aperture. To lower the rod string, it first needs to be released at surface, where a clamp conventionally secures the topmost section called the polished rod. At this point the pump is isolated from the test environment. Once again, at step 222, a pressure testing fluid is injected from surface down the tubing string, and at step 224 pressurization of the tubing string commences, with measurement of the pressurization as described above. Identification of the failed component can then be undertaken based on the two pressure tests.

Figure 11:
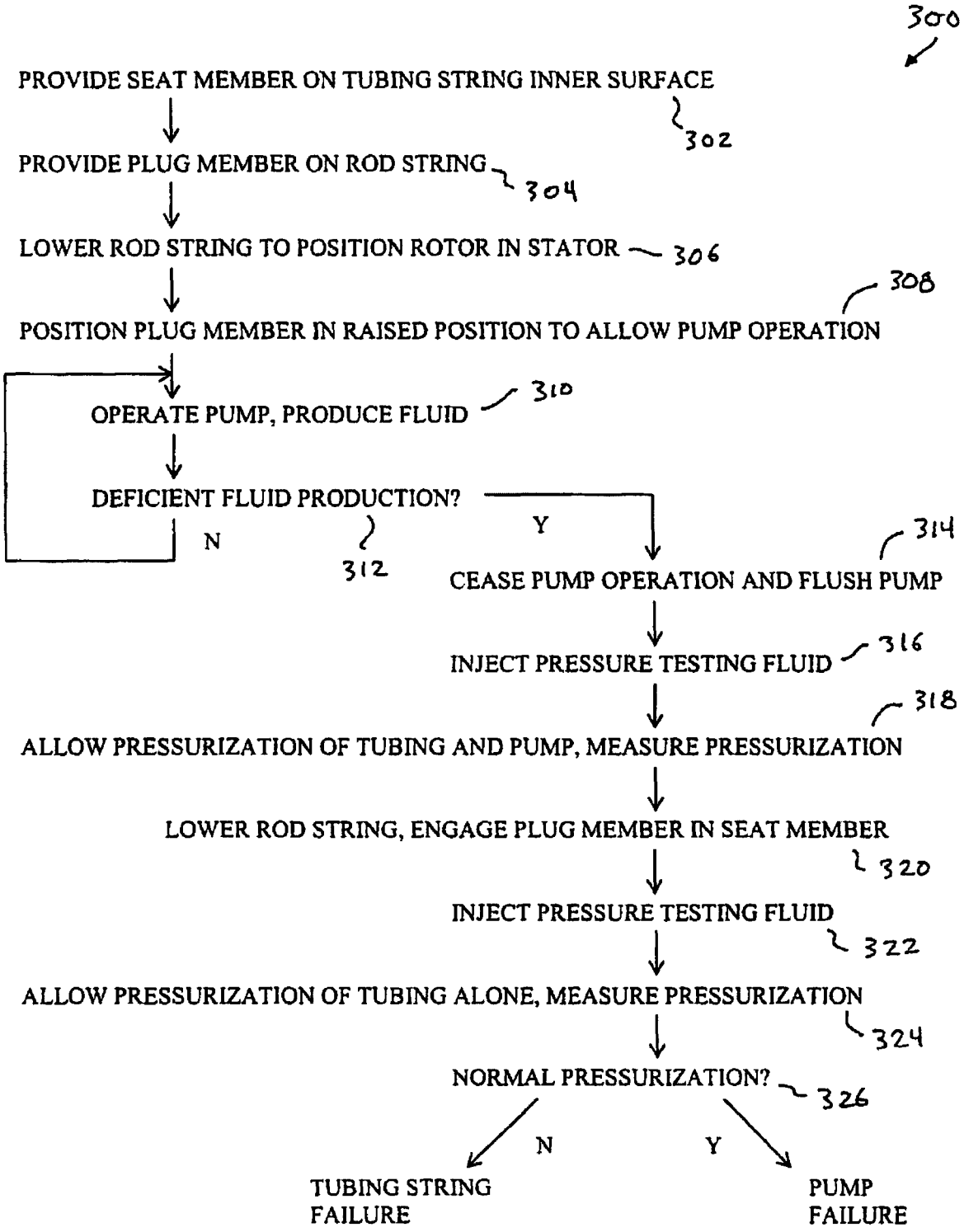
FIG. 11 is a flowchart illustrating an exemplary method in accordance with an embodiment of the present invention.

Turning now to FIG. 11, a second but similar method 300 is illustrated, including two determination points relating to use of the exemplary method where deficient fluid production has been detected. It should be noted that low fluid production as such is not necessarily the result of downhole equipment failure—for example, deficient fluid production levels could be caused by plugging of reservoir porosity by sand—but the method 300 can be used to provide an indication of a potential equipment failure. The method 300 commences with the provision of a seat member on the tubing string inner surface at step 302 and the provision of a plug member on the rod string above the seat member at step 304, as described above. After the tubing string has been lowered into the well with the PCP stator at its lower end, the rod string is lowered within the tubing string at step 306 to position the rotor within the stator cavity. As indicated above, this step 306 can optionally incorporate a top tag, such that once the plug member fully engages the seat member the rod string is blocked from further downward movement and the rotor is thus placed in a desired location within the stator cavity, and the rod string would be spaced out to ensure a desired rod string tension. Whether or not a top tag action is used with the method 300, at step 308 the rod string is pulled upwardly to lift the plug member into the raised or pump operation position, disengaged from the seat member. The PCP can then be operated at step 310 and fluid can be produced.

At this point in the method 300, a determination point is reached. A determination is made as to whether fluid production is at anticipated levels, which determination can be made using any number of methods and techniques known to those skilled in the art. If fluid production is at anticipated or acceptable levels, pump operation and fluid production can continue at step 310. If, however, it is determined that the fluid production is deficient, pump operation is halted and the pump is flushed (pulling the rotor from the stator and allowing fluid to drain through the stator) at step 314, and a pressure test then commences.

An initial pressurization test occurs at steps 316 and 318, comprising injecting a pressure testing fluid down the tubing string to the pump at step 316, and allowing pressurization within the tubing string and pump at step 318. Again, at this stage the pump has not been isolated. The quantum of pressurization can be measured, as can the time it takes for the pressurization to decline after injection ceases. If the pressurization is measured to be less than should be expected under normal circumstances with the downhole equipment in good operating condition, or the pressurization declines more rapidly than should be the case, this indicates a potential failure somewhere in the tubing string or the pump.

At step 320, isolation of the pump is undertaken as a way to clarify the location of the potential failure. The rod string is lowered to the pressure testing position such that the plug member engages and seals the aperture, thus fully obstructing flow downwardly through the aperture. At this point the pump is isolated from the test environment. Once again, at step 322, a pressure testing fluid is injected from surface down the tubing string, and at step 324 pressurization of the tubing string commences, with measurement of the pressurization as described above. At this point a second determination is made, namely whether the measured pressurization with the pump isolated is within a normal or expected range. If it is determined that the measured pressurization is within a normal or expected range, this indicates that the potential failure occurred in the pump, which had been isolated for the pressure test. If it is determined that the measured pressurization is not within a normal or expected range, this indicates that the potential failure occurred in the tubing string (although it is conceivable but unlikely that a potential failure has also occurred in the pump at the same time). This allows for corrective measures to be undertaken.

As can be seen by those skilled in the art, embodiments of the present invention can provide significant advantages over the prior art, including differentiating between tubing string and pump failures without requiring undesirable equipment expense and while reducing well down-time. Unnecessary rotor pulls and swaps can be avoided, as can expensive tubing scans.

Unless the context clearly requires otherwise, throughout the description and the claims:

"comprise", "comprising", and the like are to be construed in an inclusive sense, as opposed to an exclusive or exhaustive sense; that is to say, in the sense of "including, but not limited to".

"connected", "coupled", or any variant thereof, means any connection or coupling, either direct or indirect, between two or more elements; the coupling or connection between the elements can be physical, logical, or a combination thereof.

"herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

The invention claimed is:

1. A method for pressure testing a tubing string in a fluid production well having a downhole progressing cavity pump comprising a rotor and a stator, the tubing string having a longitudinal axis, a rod string and the rotor of the pump being part of a rod string assembly axially moveable within the tubing string along the longitudinal axis of the tubing string, the method comprising the steps of:

a. providing a seat member operably disposed within the tubing string at a point above the stator, the seat member comprising a surface disposed above the stator that defines a centrally-disposed aperture;

b. providing a plug member operably disposed on the rod string assembly at a point above the rotor, the plug member comprising a surface disposed above the rotor that is configured for mating with the surface of the seat member and sealing the aperture, the plug member moveable between a raised position in which the aperture is unobstructed by the plug member to fluidly couple the tubing string and the pump, and a lowered position in which the plug member seals and fully obstructs the aperture to fluidly isolate the tubing string from the pump;

c. positioning the plug member in the raised position and operating the pump to produce a production fluid through the aperture and up the tubing string;

d. ceasing operation of the pump;

e. with the plug member in the raised position, injecting a well pressure testing fluid from surface down the tubing string to the pump;

f. measuring pressurization of the well pressure testing fluid;

g. lowering the rod string assembly to position the plug member in the lowered position such that the plug member engages and seals the aperture, thus fully obstructing flow downwardly through the aperture and fluidly isolating the tubing string from the pump;

h. with the plug member in the lowered position, injecting a tubing string pressure testing fluid from surface down the tubing string;

i. allowing pressurization of the tubing string pressure testing fluid within the tubing string; and j. measuring the pressurization.

2. The method of claim 1 further comprising the following step between steps b. and c.:

lowering the rod string assembly to position the plug member in the lowered position in order to locate the rotor at a desired location within the pump.

3. The method of claim 1 wherein measuring the pressurization comprises measuring the quantum of the pressurization of the tubing string pressure testing fluid and/or measuring the period and rate over which the pressurization releases.

4. A method for isolating a downhole progressing cavity pump for a tubing string pressure test, the tubing string having a longitudinal axis, the pump comprising a rotor and a stator, a rod string and the rotor of the pump being part of a rod string assembly that is axially moveable within the tubing string along the longitudinal axis of the tubing string, the method comprising the steps of:

a. providing a seat member operably disposed within the tubing string at a point above the stator, the seat member comprising a surface disposed above the stator that defines a centrally-disposed aperture;

b. providing a plug member operably disposed on the rod string assembly at a point above the rotor, the plug member comprising a surface disposed above the rotor that is configured for mating with the surface of the seat member and sealing the aperture, the plug member moveable between a raised position in which the aperture is unobstructed by the plug member to fluidly couple the tubing string and the pump, and a lowered position in which the plug member seals and fully obstructs the aperture to fluidly isolate the tubing string from the pump;

c. positioning the plug member in the raised position and operating the pump to produce a production fluid through the aperture and up the tubing string;

d. ceasing operation of the pump;

e. with the plug member in the raised position, injecting a well pressure testing fluid from surface down the tubing string to the pump;

f. measuring allowing pressurization of the well pressure testing fluid;

g. lowering the rod string assembly to position the plug member in the lowered position such that the plug member engages and seals the aperture, thus fully obstructing flow of fluid downwardly through the aperture and fluidly isolating the tubing string from the pump;

h. with the plug member in the lowered position, injecting a tubing string pressure testing fluid from surface down the tubing string;

i. allowing pressurization of the tubing string pressure testing fluid within the tubing string above the plug member; and j. measuring the pressurization.

5. The method of claim 4 further comprising the following step between steps b. and c.:

lowering the rod string assembly to position the plug member in the lowered position in order to locate the rotor at a desired location within the pump.

6. The method of claim 4 wherein measuring the pressurization comprises measuring the quantum of the pressurization of the tubing string pressure testing fluid and/or measuring the period and rate over which the pressurization releases.

7. The method of claim 4 wherein, when the tubing string is fluid isolated from the pump, the tubing string pressure testing fluid does not impinge on the pump.

8. A method for failure testing of a progressive cavity pump comprising a rotor and stator, the stator being located at a downhole end of a tubing string within a fluid production well, the tubing string having a longitudinal axis, a rod string and the rotor of the pump being part of a rod string assembly that is axially moveable within the tubing string along the longitudinal axis of the tubing string, the method comprising the steps of:

a. providing a seat member operably disposed on the tubing string at a point above the stator, the seat member comprising a surface disposed above the stator that defines a centrally-disposed aperture;

b. providing a plug member operably disposed on the rod string assembly at a point above the rotor, the plug member comprising a surface disposed above the rotor that is configured for mating with the surface of the seat member and sealing the aperture, the plug member moveable between a raised position in which the aperture is unobstructed by the plug member to fluidly couple the tubing string and the pump, and a lowered position in which the plug member seals and fully obstructs the aperture to fluidly isolate the tubing string from the pump;

c. operating the pump to produce a production fluid;

d. detecting a deficient fluid production from the well indicative of a potential downhole equipment failure;

e. ceasing operation of the pump;

f. with the plug member in the raised position, injecting a well pressure testing fluid from surface down the tubing string to the pump;

g. measuring pressurization of the well pressure testing fluid;

h. lowering the rod string assembly to position the plug member in the lowered position such that the plug member engages and seals the aperture, thus fully obstructing flow of fluid downwardly through the aperture and fluidly isolating the tubing string from the pump;

i. with the plug member in the lowered position, injecting a tubing string pressure testing fluid from surface down the tubing string;

j. allowing pressurization of the tubing string pressure testing fluid within the tubing string above the plug member;

k. measuring the pressurization; and l. determining whether the pressurization indicates a potential tubing string failure or a potential pump failure.

9. The method of claim 8 further comprising the following step between steps b. and c.:

lowering the rod string assembly to position the plug member in the lowered position in order to locate the rotor at a desired location within the pump; and raising the rod string assembly to position the plug member in the raised position.

10. The method of claim 8 wherein measuring the pressurization comprises measuring the quantum of the pressurization of the tubing string pressure testing fluid and/or measuring the period and rate over which the pressurization releases.

11. The method of claim 8 wherein, when the tubing string is fluid isolated from the pump, the tubing string pressure testing fluid does not impinge on the pump.

12. The method of claim 8 wherein the step of determining whether the pressurization indicates a potential tubing string failure or a potential pump failure comprises determining whether the pressurization is within normal parameters, pressurization within normal parameters indicating a potential failure of the pump that was isolated during pressurization.

* * * * *